US005192943A

United States Patent [19]

Matsuo et al.

[11] Patent Number: 5,192,943

[45] Date of Patent: Mar. 9, 1993

[54] CURSOR DISPLAY CONTROL METHOD AND APPARATUS IN A GRAPHIC DISPLAY SYSTEM

[75] Inventors: Shigeru Matsuo; Tadashi Fukushima; Tooru Komagawa; Masahisa Narita, all of Hitachi, Japan

[73] Assignees: Hitachi, Ltd., Tokyo; Hitachi Engineering Co., Ltd., Ibaraki, both of Japan

[21] Appl. No.: 583,584

[22] Filed: Sep. 17, 1990

[30] Foreign Application Priority Data

Sep. 20, 1989 [JP] Japan ..... 1-242256

[51] Int. Cl.[5] ..... G09G 3/02

[52] U.S. Cl. ..... 340/709; 340/706

[58] Field of Search ..... 340/706, 709, 710, 723, 340/750; 273/148 B

[56] References Cited

U.S. PATENT DOCUMENTS 4,326,201 4/1982 Enokizono ..... 340/750
4,454,507 6/1984 Srinivasan et al. ..... 340/709
4,706,074 11/1987 Muhich et al. ..... 340/709
4,768,029 8/1988 Burrows ..... 340/709
4,835,526 5/1989 Ishii et al. ..... 340/709

*Primary Examiner*—Ulysses Weldon
*Assistant Examiner*—M. Fatahiyar
*Attorney, Agent, or Firm*—Antonelli, Terry, Stout & Kraus

[57] ABSTRACT

A cursor display control in a graphic display system is provided in which a storage range is provided for exclusive use for a cursor pattern and a desired shape is defined in the storage range to thereby perform a high-speed cursor movement. A display control apparatus in the graphic display system includes a memory for storing a cursor pattern, shift register for performing a shift processing in a non-display period of the cursor for positioning in the display screen, and parallel-serial converter for performing parallel to serial conversion at the display timing of the cursor, whereby the apparatus is suitable to be integrated in the form of an LSI and the cursor can be moved at a high speed on the screen.

13 Claims, 14 Drawing Sheets

CURSOR DISPLAY CONTROL METHOD AND APPARATUS IN A GRAPHIC DISPLAY SYSTEM

BACKGROUND OF THE INVENTION

The present invention relates to a cursor display control method in a graphic display system, and particularly to a display control apparatus which has a special storage region for exclusive use for a cursor pattern so that a desired shape is defined in the storage region and has a preferred cursor display function for displaying the defined shape as a cursor.

As a conventional graphic cursor display system, there has been known, for example, a system in which a cursor pattern is drawn on a frame buffer together with graphic information so that they are displayed on a screen. In this system, there is indeed an advantage that a desired cursor pattern can be displayed and hardware can be simplified, but the cursor pattern must be drawn on the frame buffer by means of a CPU or the like whenever a cursor is moved. It is further necessary to perform a processing for stacking or resuming the graphic information of an overlapped portion, when there has been a problem in the operating speed.

As an alternative one, there has been a system having a special frame buffer for exclusive use for a cursor to thereby eliminate the above-mentioned processing for stacking or resuming. In this system, however, a cursor pattern must be still drawn by means of a processing means such as a CPU whenever the cursor is moved, so that it is impossible to conspicuously improve the operating speed.

Therefore, a system having a special memory for exclusive use for a cursor in which a cursor pattern is defined in the memory and the display read processing for a frame memory and the display read processing for the cursor pattern are executed in parallel is described in the paper by Kazuo Minorigawa et al., entitled "CRT controller which can assign a drawing position with coordinates and has various commands such as painting-out, copying, etc.", Nikkei Electronics, pp. 221 to 254, May 21, 1984. FIG. 3 is a block diagram illustrating this system. This system is constituted by a CRT controller (ACRTC) 1000 for performing display control, a cursor pattern memory 1030, a counter 1010 for generating an address of the memory 1030, shift registers 1040 and 1050 for converting the data of the memory 1030 into a video signal, an output position adjusting circuit 1020 for performing display position control dot by dot on a screen, and a multiplexer 1060. According to the system, it is not necessary to perform a processing for rewriting a cursor pattern correspondingly to the movement of a cursor, so that it is possible to expect to make the speed of movement of the cursor high on the screen.

On the other hand, in order to solve the problem in the above-mentioned conventional technology in which it has been required to have a special memory for exclusive use for a cursor pattern, there has been a system as disclosed in Japanese Patent Laid-Open JP-A-63-52182. In this system, a portion of a frame buffer is used for a memory for use for a cursor pattern. That is, in this system, since it is not possible to make frame buffer access for displaying a cursor and a background thereof at the same time, a cursor pattern is read in advance in a non-display time of a CRT.

In the above-mentioned conventional technology, however, the access of a cursor pattern is performed not bit by bit but word by word of, for example, 16 or 32 bits. On the other hand, each picture element is displayed on a screen not word by word, but, for example, bit by bit in the case of monochrome display, or by four bits in the case of 16-color display. In order to move a cursor dot by dot on the screen, therefore, it has been necessary to provide, outside a CRT controller, a circuit for controlling a bit displacement within every word, as shown in FIG. 3. The above-mentioned circuit converts a one-word parallel signal into serial signals bit by bit while performing a dot position adjustment processing for the screen display of the cursor pattern. Since the above-mentioned serial signals are to be supplied as a video signal to a CRT, a high speed device is required for the above-mentioned circuit for producing the signals.

As has been described above, in the above-mentioned conventional technology, since it has been necessary to provide, outside a CRT controller, a circuit using a high speed device, there has been a problem that the system as a whole becomes expensive.

Moreover, since such a high speed operation required in the above-mentioned circuit is difficult to be realized by the current technique of CMOS (Complementary Metal Oxide Semiconductor) circuits which is being applied to large scale integrated circuits, there has been a problem when the above-mentioned circuit is integrated in the form of an LSI.

There has been proposed a further system as disclosed in Japanese Patent Laid-Open JP-A-59-95588, in which a special plane for exclusive use for a cursor is provided in a frame buffer as a memory for display in addition to another plane for general use for a screen, and parallel data supplied from the special plane for exclusive use for the cursor are shifted dot by dot in accordance with the displacement quantity set in a cursor address register and then converted into serial data.

Also in this conventional technology, however, it is necessary to provide, outside a CRT controller, a circuit for controlling the displacement dot by dot, and there is no description about integration of the circuit into an LSI. Moreover, the shift operation for the displacement must be performed synchronously with the parallel to serial conversion, resulting in prevention against making the speed high.

SUMMARY OF THE INVENTION

It is therefore an object of the present invention to solve the foregoing problems in the conventional technology.

It is another object of the present invention to provide a cursor display control method and an apparatus therefor in a graphic display system, in which it is possible to realize a high speed cursor movement on a screen while reducing the number of circuits operating at a high speed as possible, and which can be easily integrated in the form of an LSI.

In order to attain the foregoing objects, according to an aspect of the present invention, the cursor display control apparatus comprises pattern storage means for performing a cursor pattern, shift means for performing, at a cursor non-display time, the shift operation for the position adjustment on a display screen, and means for performing the parallel to serial conversion at a proper cursor display timing.

In the above-mentioned apparatus according to the present invention, pattern data are shifted by the above-mentioned shift means in advance before the cursor display timing to thereby adjust the bit displacement within every word according to a display position. Then, at the cursor display timing, the pattern data are converted into serial data on the basis of the instruction by a cursor display signal, combined with screen display data, and then supplied to a display unit.

As has been described above, since serial data converting processing for generating cursor pattern display data is separated from pattern data shift processing for adjusting the display position of the pattern, it is possible to realize a high speed movement of a cursor on a screen without operating dot position adjustment processing at a high speed for the screen display of the pattern. Moreover, since the configuration of the above-mentioned apparatus can be built in an LSI, it is possible to realize an inexpensive display control apparatus having a cursor display function.

BRIEF DESCRIPTION OF THE DRAWINGS

Other features and advantages of the present invention will be apparent from the following description taken in connection with the accompanying drawings, wherein.

DESCRIPTION OF THE PREFERRED EMBODIMENTS

Embodiments of the present invention will be described in detail hereunder with reference to the drawings.

Figure 1:
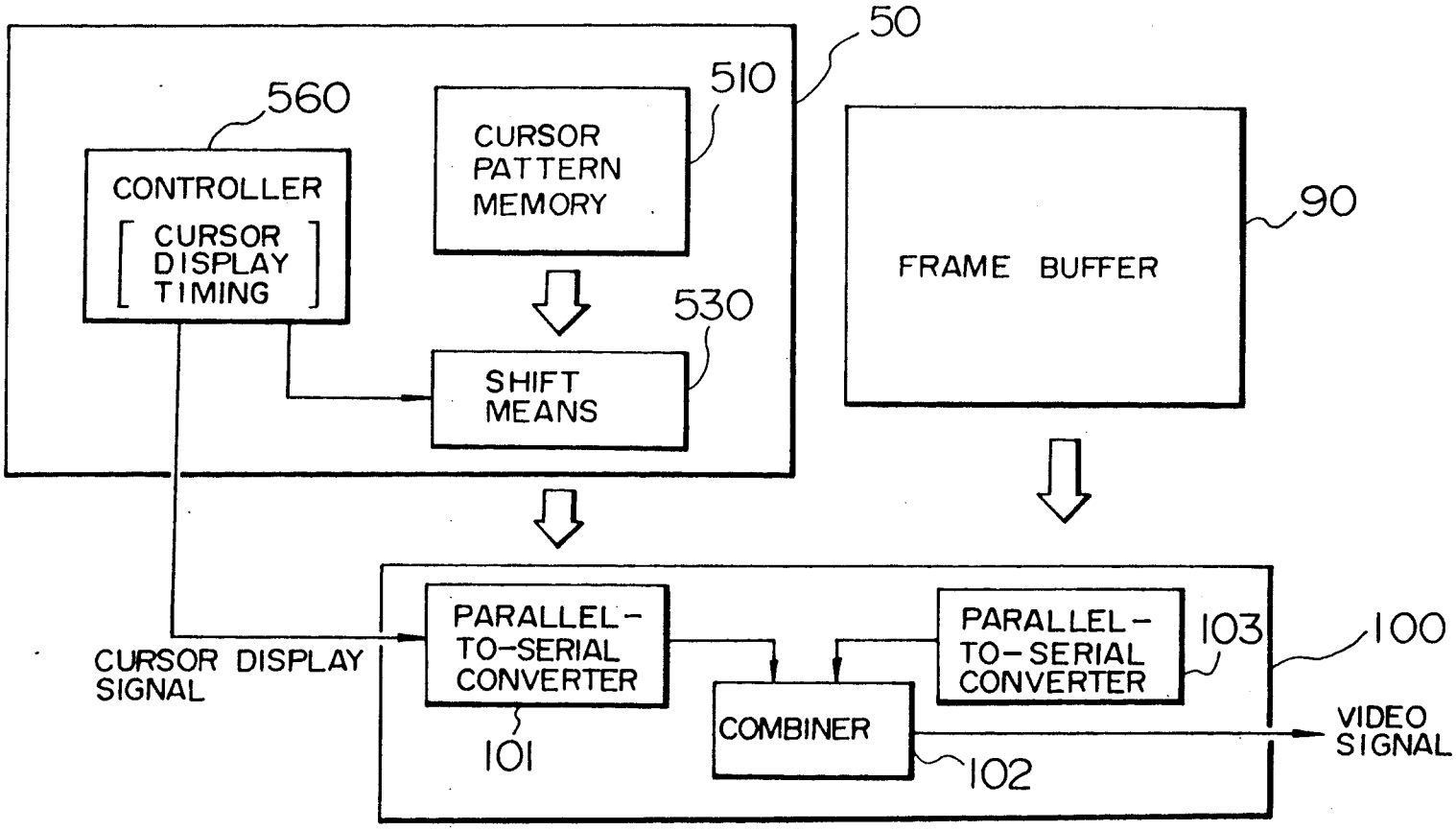
FIG. 1 is a block diagram of an embodiment of the display control apparatus in which the features of the present invention are illustrated.

FIG. 1 is a block diagram illustrating an embodiment of the display control apparatus which shows the features of the present invention. In FIG. 1, the display control apparatus includes, in addition to a frame buffer 90 for storing, in the form of a bit map, characters and figures to be displayed on a CRT display unit and a parallel to serial converter 103 for converting the data of the bit map into a video signal, at least a cursor pattern memory 510 for storing a cursor pattern, a shift means 530 for shifting the data of the cursor pattern so as to adjust the display position thereof, a parallel to serial converter 101 for converting the data shifted by the shift means 530 into a video signal, a control circuit 560 for controlling the timing of cursor display, and a combiner 102 for combining video signals.

Figure 2:
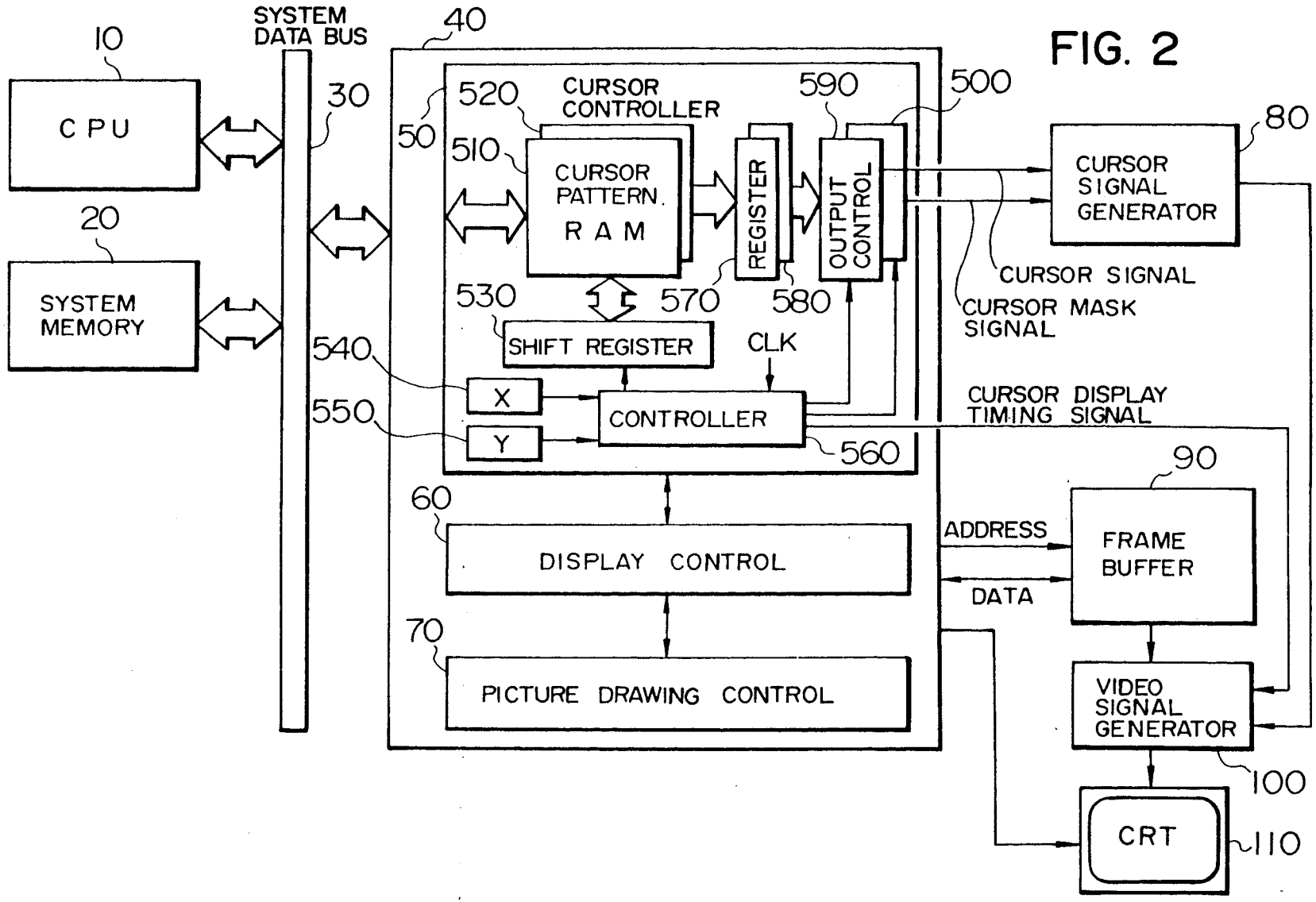
FIG. 2 is a diagram illustrating a graphic display system using a display control apparatus according to the present invention.
Figure 3:
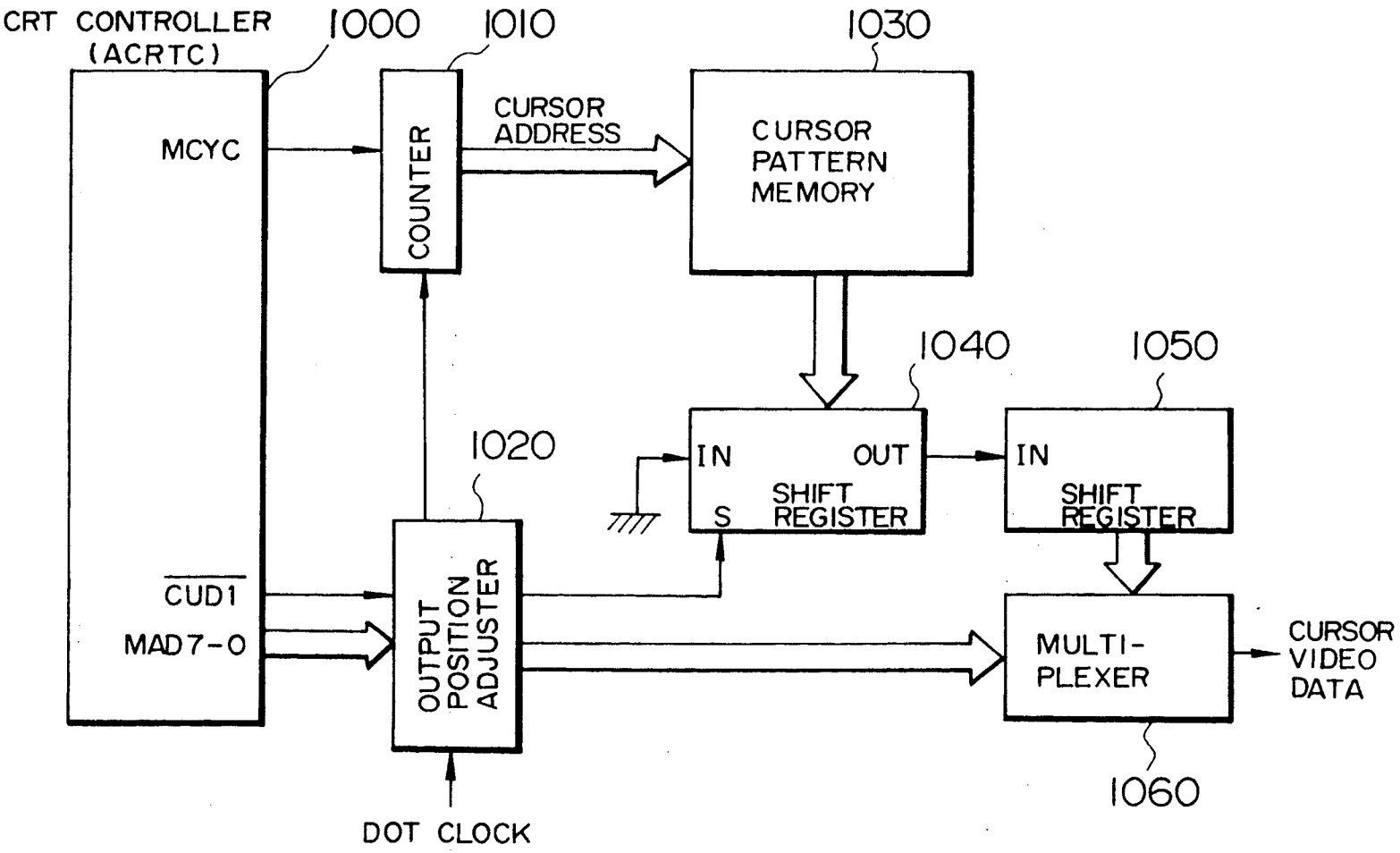
FIG. 3 PRIOR ART
FIG. 3 is a diagram illustrating a conventional cursor display system.

FIG. 2 shows an embodiment of a graphic display system in which a display control apparatus having a cursor display function according to the present invention is incorporated. The operation of the graphic display system will now be described. A central processing unit (CPU) 10 executes a program stored in a system memory 20 so as to control not only a display control apparatus 40 but the system through a system bus 30. The display control apparatus 40 is constituted by a cursor control circuit 50 for controlling the display of a cursor, a display control circuit 60 for displaying the data of the frame buffer 90 on a CRT 110, and a drawing control circuit 70 for drawing characters or figures on the frame buffer 90. In this embodiment, the display control apparatus 40 is built in one LSI.

The CPU 10 issues a command to the drawing control circuit 70 for drawing a figure on the frame buffer 90. FIGS. to be drawn are defined in advance in accordance with various commands, so that the drawing control circuit 70 can draw a figure such as a line, a circle or the like in accordance with the command given by the CPU 10. The display control circuit 60 reads the frame buffer 90 periodically to make display on the CRT 110, and produces a synchronizing signal to be supplied to the CRT 110. The data read from the frame buffer 90 are converted into a video signal by a video signal generating circuit 100, and the read-out video signal is supplied to the CRT 110.

The cursor control circuit 50, which is the pivot of the present invention, is constituted by cursor pattern RAMs 510 and 520, a shift register 530, a cursor display position register-X 540, a cursor display position register-Y 550, cursor data display reading registers 570 and 580, output control circuits 590 and 500, and a cursor display control circuit 560. The cursor display position register-X 540 and the cursor display position register-Y 550 are connected to a slave register-X(S) 541 and a slave register-Y(S) 551 of FIG. 4 so as to constitute master to slave arrangements, respectively. The timing of data transfer from the master side to the slave side is the start time of a vertical blanking interval. As a result, the CPU 10 can change the set value for the slave register-X(S) 541 and the slave register-Y(S) 551 independently of the operation of the cursor control circuit 50. The above-mentioned cursor data are supplied to the cursor signal generating circuit 80 so as to be converted into a video signal which is in turn mixed with the video data of the frame buffer 90 in the video signal generating circuit 100 so as to be displayed on the CRT 110.

Figure 4:
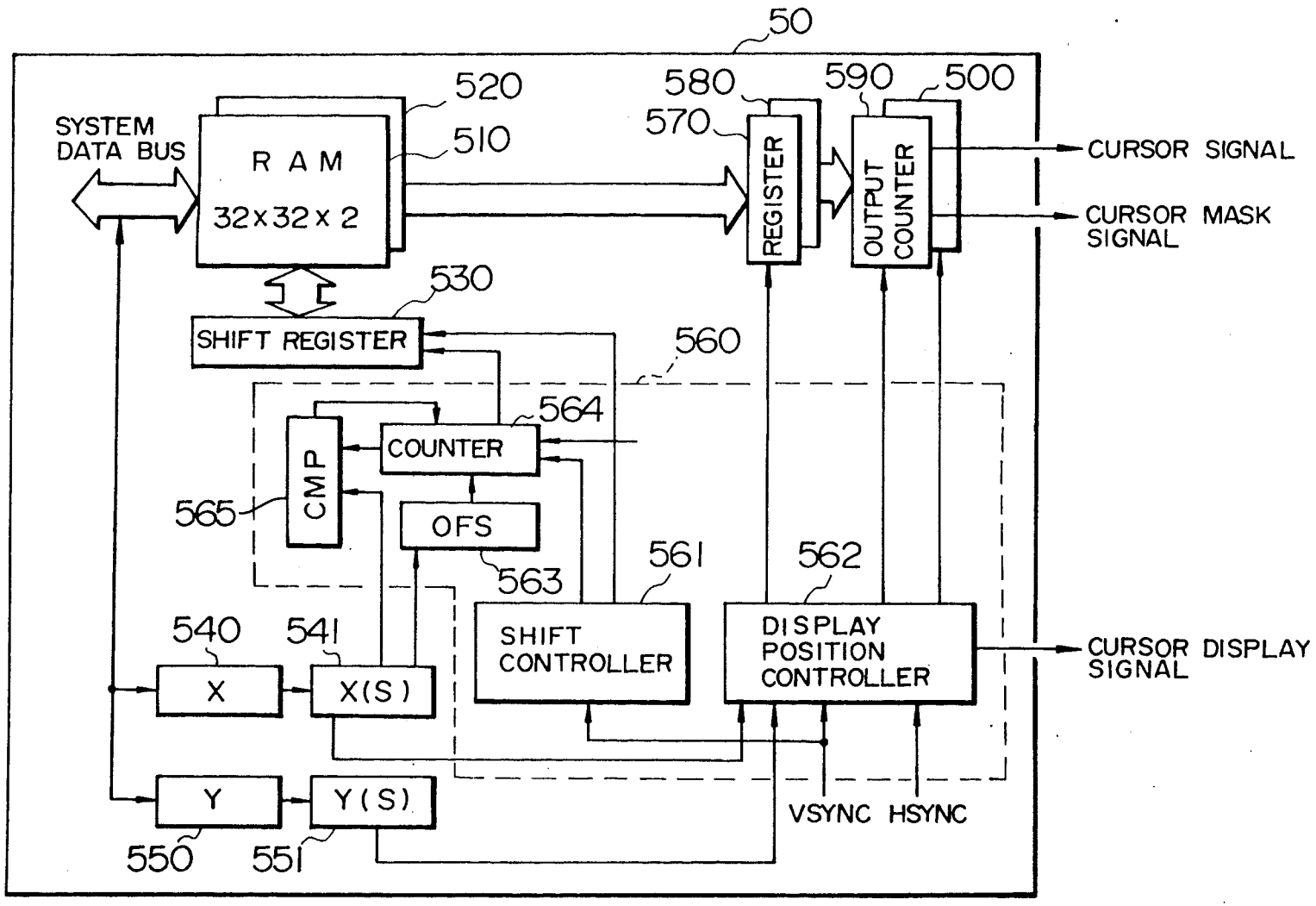
FIG. 4 is a block diagram illustrating a display control apparatus according to the present invention.

Next, the cursor display system according to the present invention will be described. FIG. 4 is a block diagram illustrating the cursor control circuit 50 in detail. The shape of a cursor is defined in advance in the cursor pattern RAMs 510 and 520 by the CPU 10. When the cursor is to be displayed on the screen of the CRT 110, first, the display position is assigned in the cursor display position registers 540 and 550. On the basis of a vertical synchronizing signal (VSYNC), a shift control circuit 561 detects that the scanning line of the CRT 110 is in a vertical blanking interval. When the interval starts, the shift control circuit 561 reads the data of the RAM 510 by one word and sets the data in the shift register 530. In this case, although any limitation is never provided, it is assumed that the number of bits of one word in the RAM 510 is the n-th power of 2 and coincides with the number of dots of a cursor pattern in the X direction.

Figure 5:
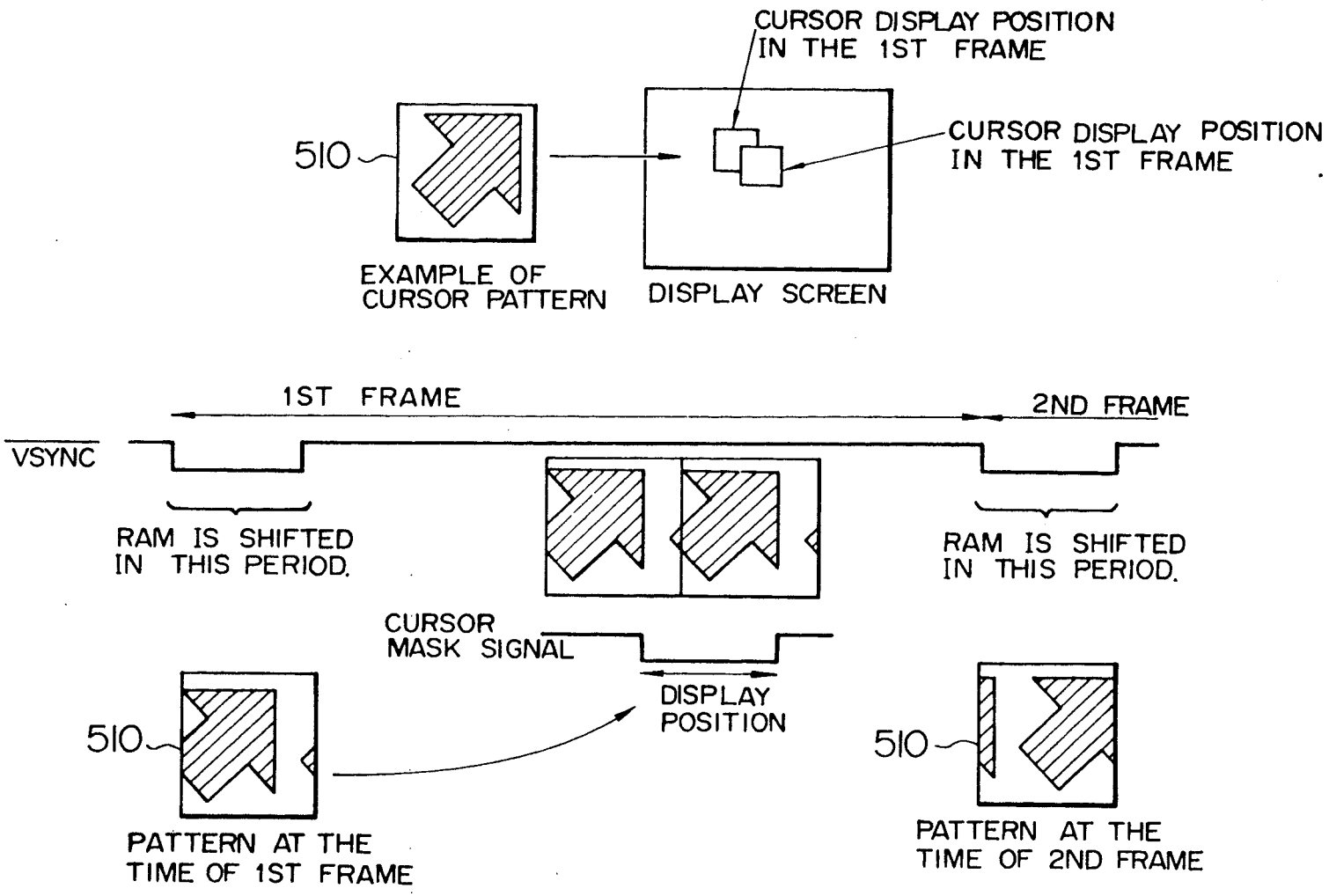
FIGS. 5 and 6 are time charts illustrating the operation of the apparatus of FIG. 4.

On the other hand, the lower n bits of the X-coordinate value before renewal of the display position of the cursor are set in a shift offset register 563. The set value is counted up one by one in a counter 564. Corresponding to this counting operation, the contents of the shift register 530 are shifted bit by bit. The shift register 530 is arranged so that its MSB output data are put into its LSB, so that data can be circulatingly shifted. The count value of the counter 564 is compared in a comparator 565 with the lower n bits of the X-coordinate value after renewal of the display position, and when the value of the counter coincides with the lower n bits, the comparator 565 gives instructions to the counter 564 to stop the operation. Consequently, the contents of the shift register 530 are shifted by the number of bits of the remainder obtained by dividing the difference between the X-coordinate values before and after renewal of the display position by the number of picture elements of the pattern in the X direction. The shift control circuit 561 performs the above-mentioned shift operation upon the whole of the RAMs 510 and 520 in a vertical blanking interval. FIG. 5 is a time chart for the operation. Generally, a vertical blanking interval is about 1000 μs, while the time required for shifting the whole data of the RAMs 510 and 520 is about 100 μs on the assumption that it takes 50 ns for one bit shift. Accordingly, there is enough shift time.

Figure 6:
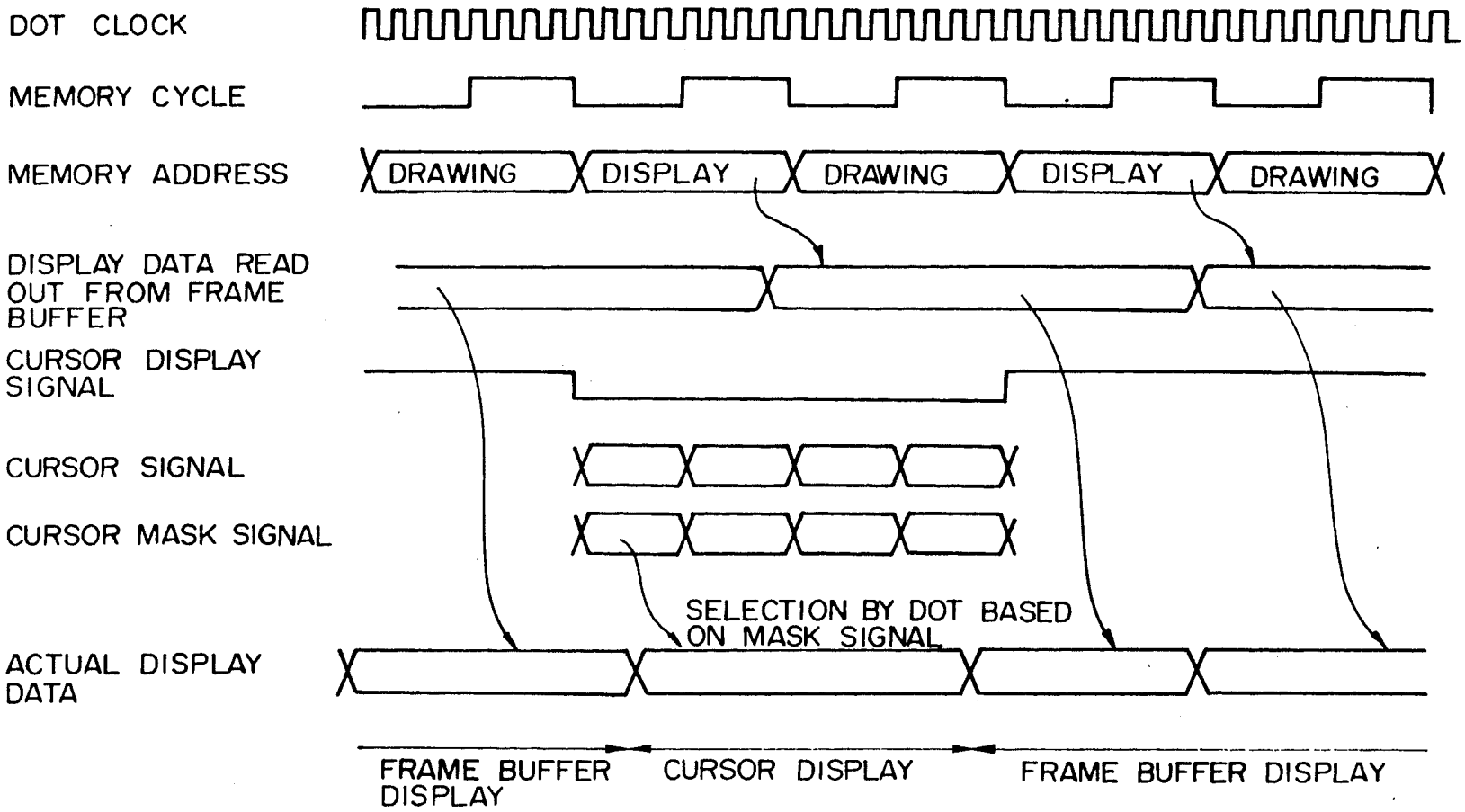

Next, description will be made as to the case where the data of the RAM 510 are to be displayed on the CRT 110. FIGS. 5 and 6 are time charts in the case of display of a cursor. A dot clock is a basic one to transfer video data to the CRT 110 with the displacement of the scanning line of the CRT 110. The memory cycle is an access period of the frame buffer 90. There are two purposes for accessing the frame buffer 90, one for drawing and the other for displaying. Accordingly, memory cycles are assigned for those two purposes so that the memory cycles for the two purposes are alternately executed. The data read in the display cycle are latched by the video signal generating circuit 100 and converted into serial signals.

On the other hand, the display position control circuit 562 of FIG. 4 determines the display timing of the cursor on the basis of synchronizing signals (VSYNC and HSYNC) and the cursor display position registers 540 and 550. When the timing reaches, the display position control circuit 562 reads the RAMs 510 and 520 into the display-read registers 570 and 580. Being not limited specifically, 32 bits of the data are sent out four bits by four bits through the output control circuits 590 and 500. Consequently, the operation at the same high frequency as that of the dot clock is reduced to ¼ in the above-mentioned example, thereby facilitating the integration of the display control apparatus 40 into an LSI. On the basis of the lower n bits of the cursor display position register 541, the output control circuit 500 forms a signal for assigning the region of bit displacement between the above-mentioned data of the registers 570 and 580, and outputs the signal after combining the signal with a signal of the register 580.

The cursor signal generating circuit 80 transfers a signal supplied from the output control circuit 590 to the video signal generating circuit 100. At this time, the display region of the cursor data is assigned by dot by a cursor mask signal. Therefore, by multiplexing the display and the cursor data of the frame buffer 90 by the above-mentioned cursor mask signal in the video signal generating circuit 100, it is possible to display a cursor which can be smoothly moved dot by dot on the CRT 110.

Figure 7:
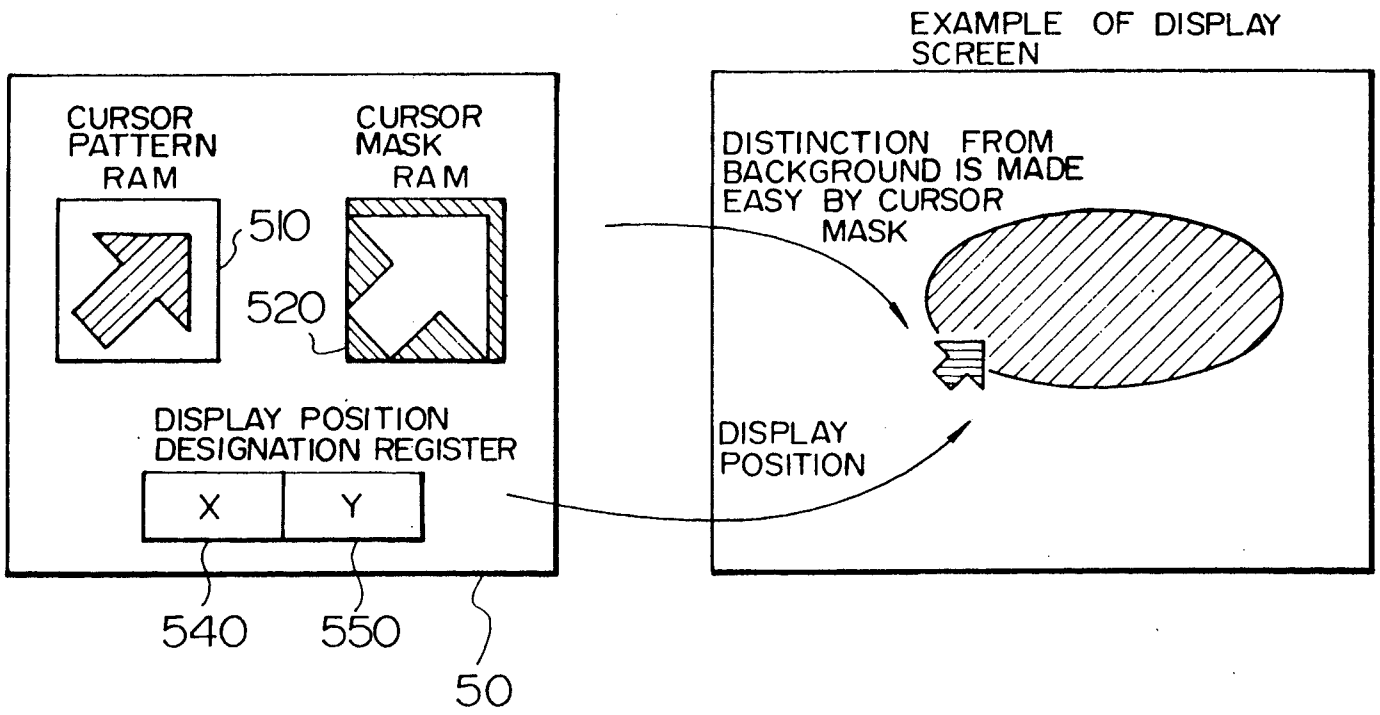
FIG. 7 is a diagram illustrating an example of the use of a cursor mask plane.

In this embodiment, as has been described above, there are two planes 510 and 520 as cursor pattern RAMs. In such a configuration, it is possible to make the display of a cursor easy to see. FIG. 7 shows an example of the operation. The cursor pattern RAM 510 defines the shape to be displayed on the screen and uses the other RAM 520 as a cursor mask RAM. As the pattern of the cursor mask RAM 520, a shape is defined so as to be a little larger by an order of one dot than that of the cursor pattern RAM 510. Display at the screen display portion corresponding to the mask signal is performed with a color different from the respective colors of the background and the cursor, the cursor is easy to see even if the background and the cursor are overlaid.

When the CPU 10 sets the cursor pattern RAM 510 and 520 again, the cursor display position registers 540, 550, 541 and 551 are reset. According to the present invention, the RAMs are stored in a shifted state so as to adjust the bit displacement on the screen. Accordingly, the cursor cannot be displayed at a correct position if the contents of the RAMs are rewritten, and the above-mentioned registers are therefore reset.

Next, two embodiments which are different from each other in timing of shifting a cursor pattern will be described hereunder.

Figure 8:
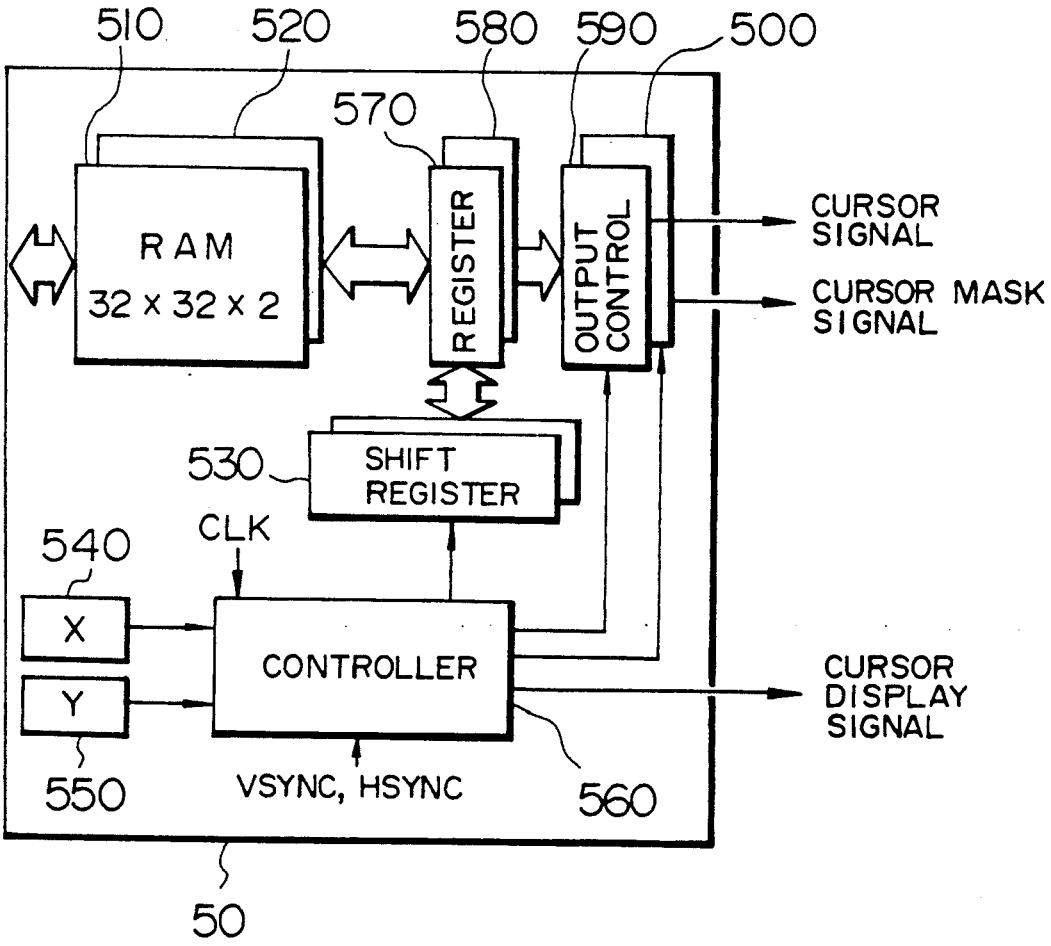
FIG. 8 is a diagram illustrating a second embodiment in which the pattern shift operation is modified.
Figure 9:
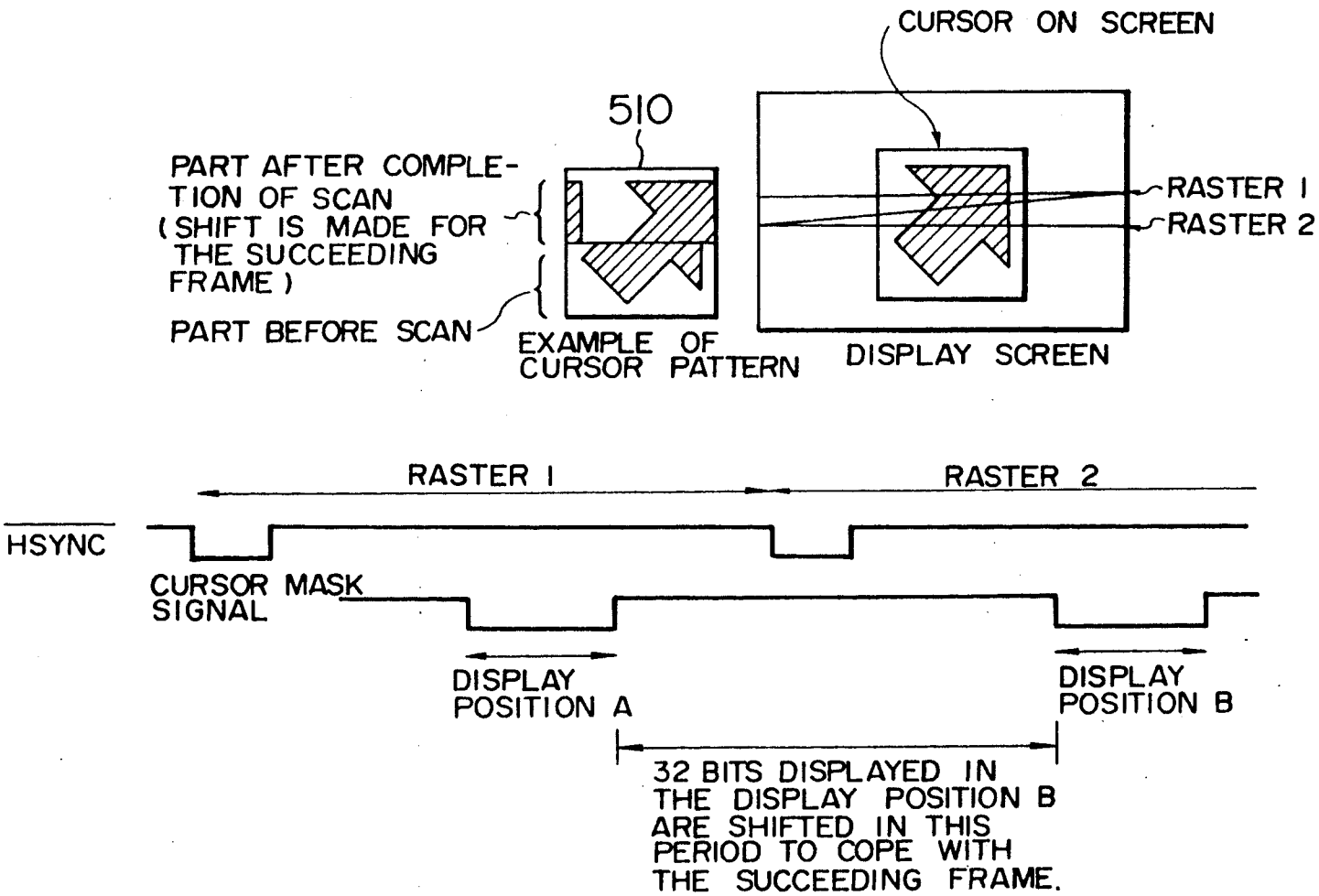
FIG. 9 is a time chart illustrating the operation of the apparatus of FIG. 8.

FIG. 8 shows a system in which after reading data of cursor pattern RAMs 510 and 520 for display, the data are shifted and then returned to the RAMs 510 and 520. FIG. 9 is a time chart in the system of FIG. 8. In synchronism with the cursor display timing, data are set in registers 570 and 580, and the data are also set in a shift register 530. Thereafter, the contents of the shift register 530 are shifted in the manner as shown in FIG. 4. The screen display is therefore on the basis of data before shifted. If one word of data has been shifted, the data is returned to its original address.

Figure 10:
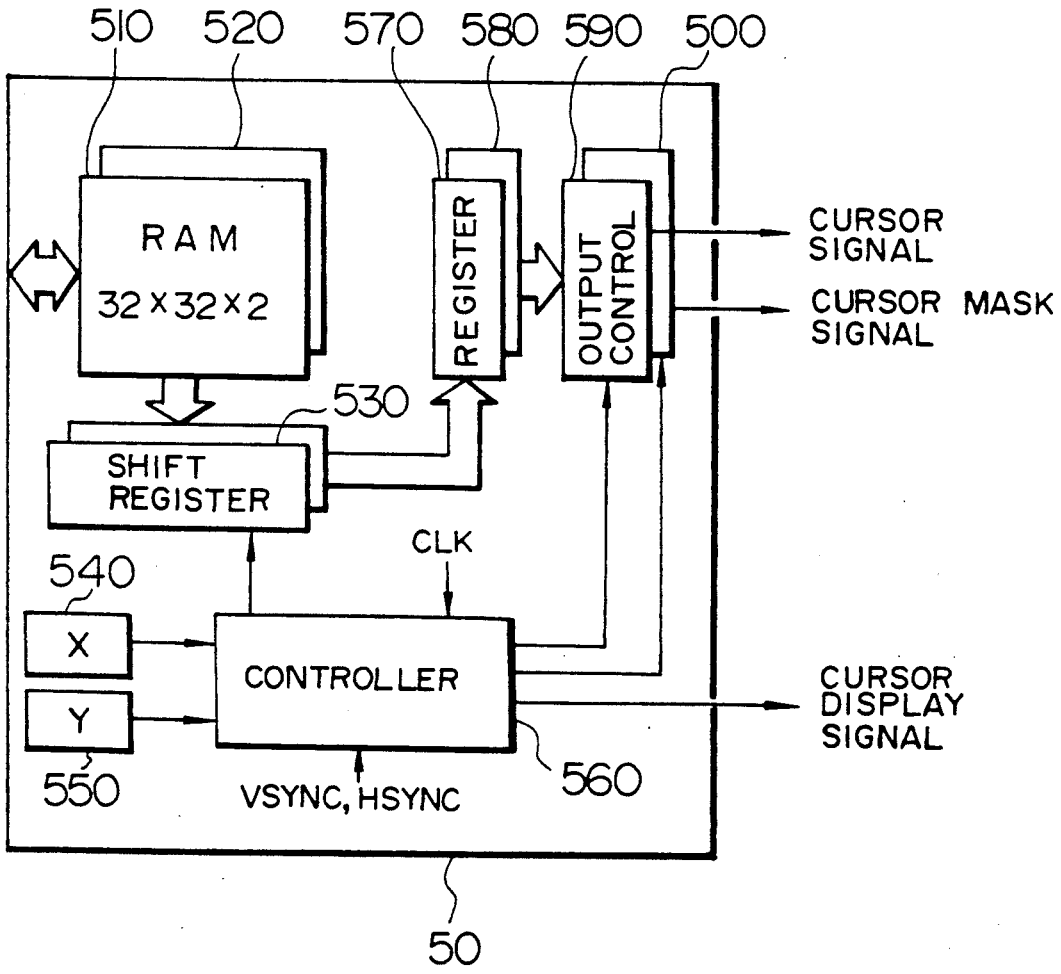
FIG. 10 is a diagram illustrating a fourth embodiment in which the pattern shift operation is modified.
Figure 11:
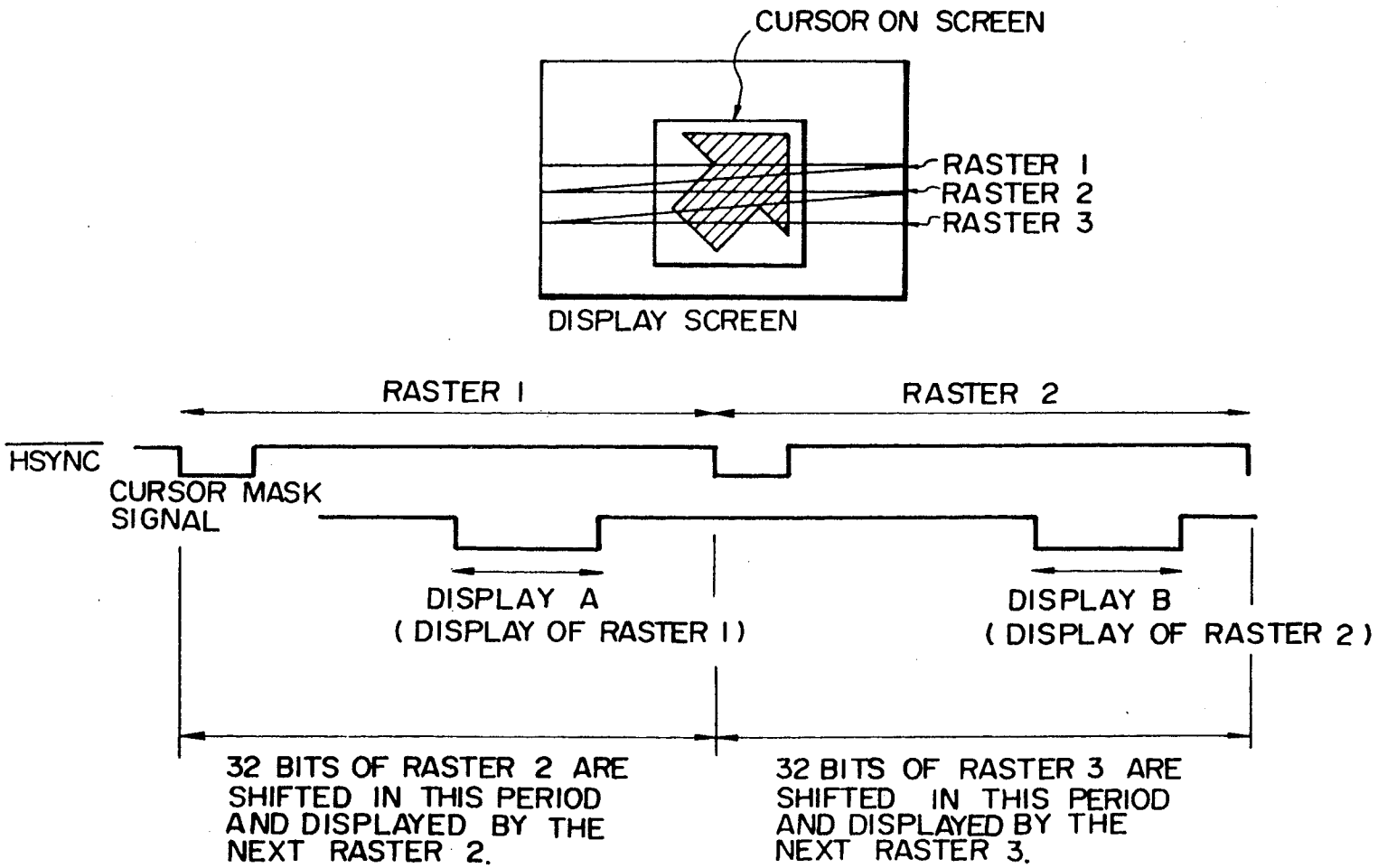
FIG. 11 is a time chart illustrating the operation of the apparatus of FIG. 10.

FIG. 10 shows a system in which data of cursor pattern RAMs 510 and 520 are read before display, shifted and then transferred to registers 570 and 580. FIG. 11 is a time chart in the system of FIG. 10. A little before the timing to display a cursor, for example, before one raster, data are read and set in a shift register 530. Thereafter, the contents of the shift register 530 are shifted in the manner as shown in FIG. 4. After completion of shifting operation, the data are set into the registers 570 and 580, and transferred through output control circuits 590 and 500 to a cursor signal generating circuit 80 synchronously with the timing of display.

Figure 12:
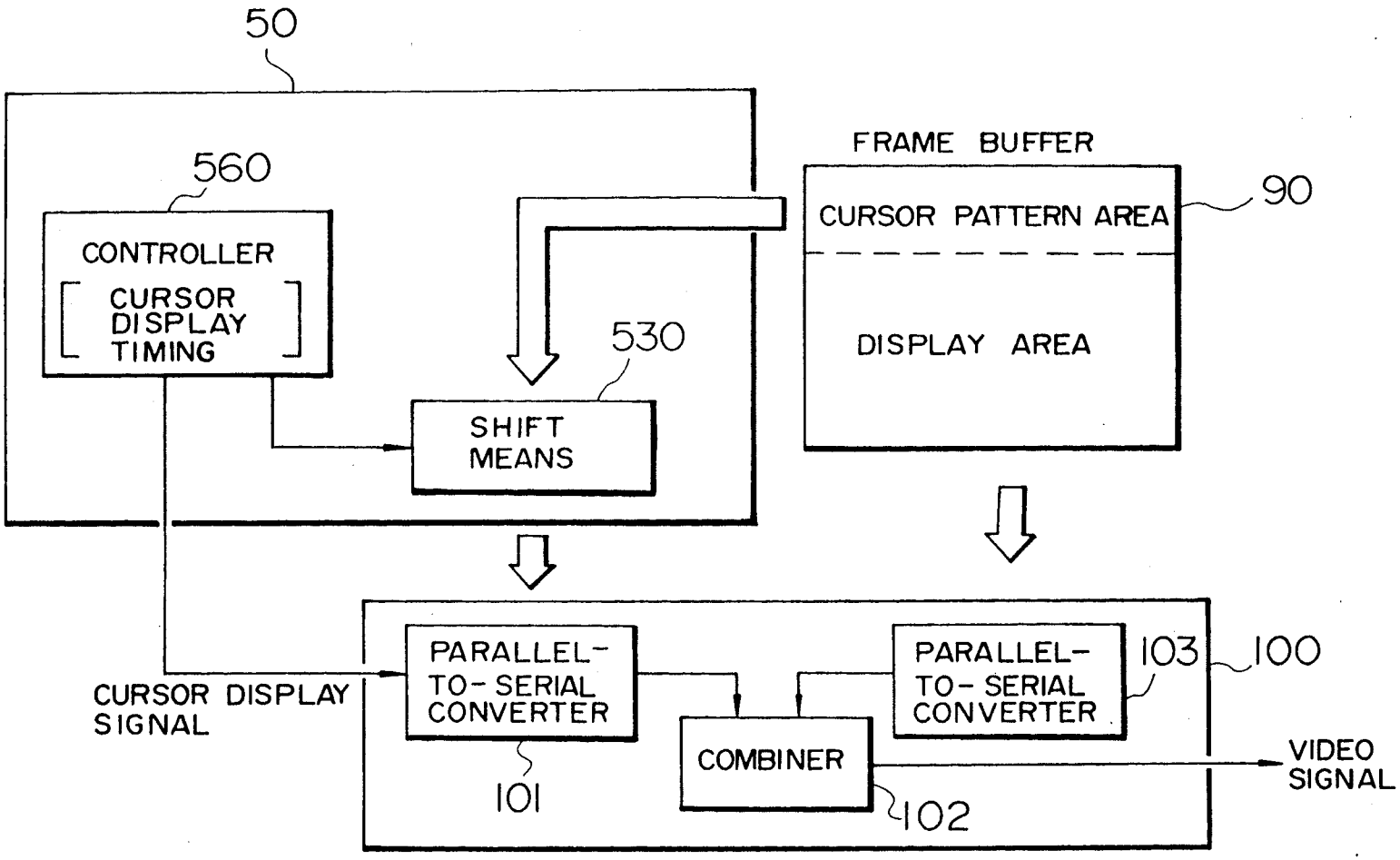
FIG. 12 is a diagram illustrating an example in which a cursor pattern is provided in a non-display region of a frame buffer.

FIG. 12 shows an embodiment in which a cursor pattern is provided in a frame buffer 90.

In the frame buffer 90, provided are two regions; one is to be displayed on the screen and the other is special for exclusive use for storing a cursor pattern. When a cursor is displayed, for example, one raster of cursor data is read at the time of starting scanning one raster before the cursor is displayed, transferred to a shift means and shifted by the number of the bit displacement in order to adjust the display position. At the timing of displaying the cursor, the above-mentioned shifted data are transferred to a video signal generating circuit. By sequentially performing such an operation for every raster, it is possible to display a cursor.

Figure 13:
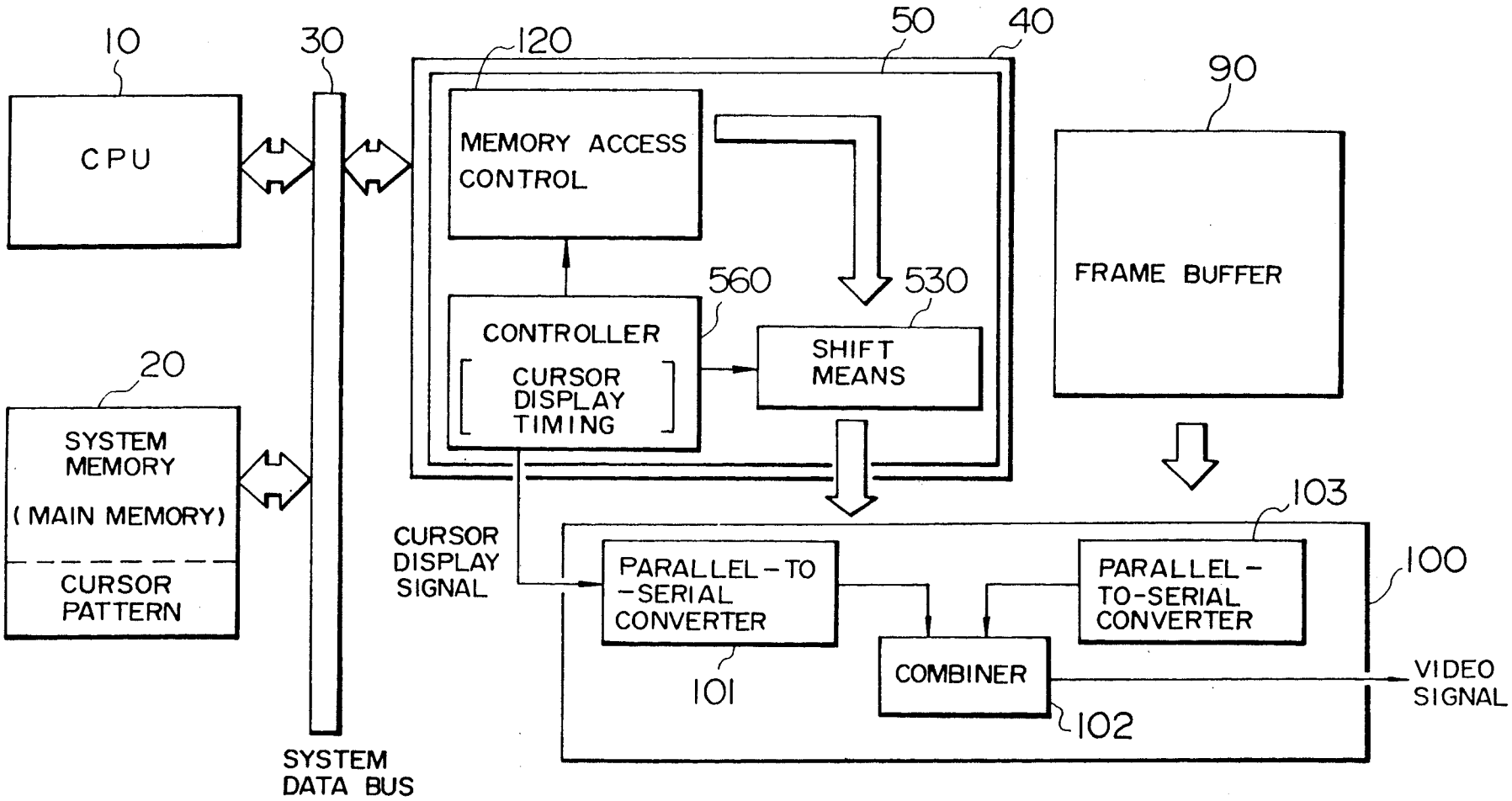
FIG. 13 is a diagram illustrating an example in which a cursor pattern is provided in a system memory.

Next, a system for storing a cursor pattern on a system memory will be described with reference to FIG. 13.

A special region for exclusive use for a cursor pattern is provided in a specific region of a system memory 20. To display a pattern of the region, for example, as has been shown in FIG. 12, a memory access control portion 120 is started one raster before displaying the pattern, and data are read from the above-mentioned pattern region.

The thus read data are converted into a video signal so as to be displayed on a CRT, for example, in the manner as has been described in FIG. 12.

Figure 14:
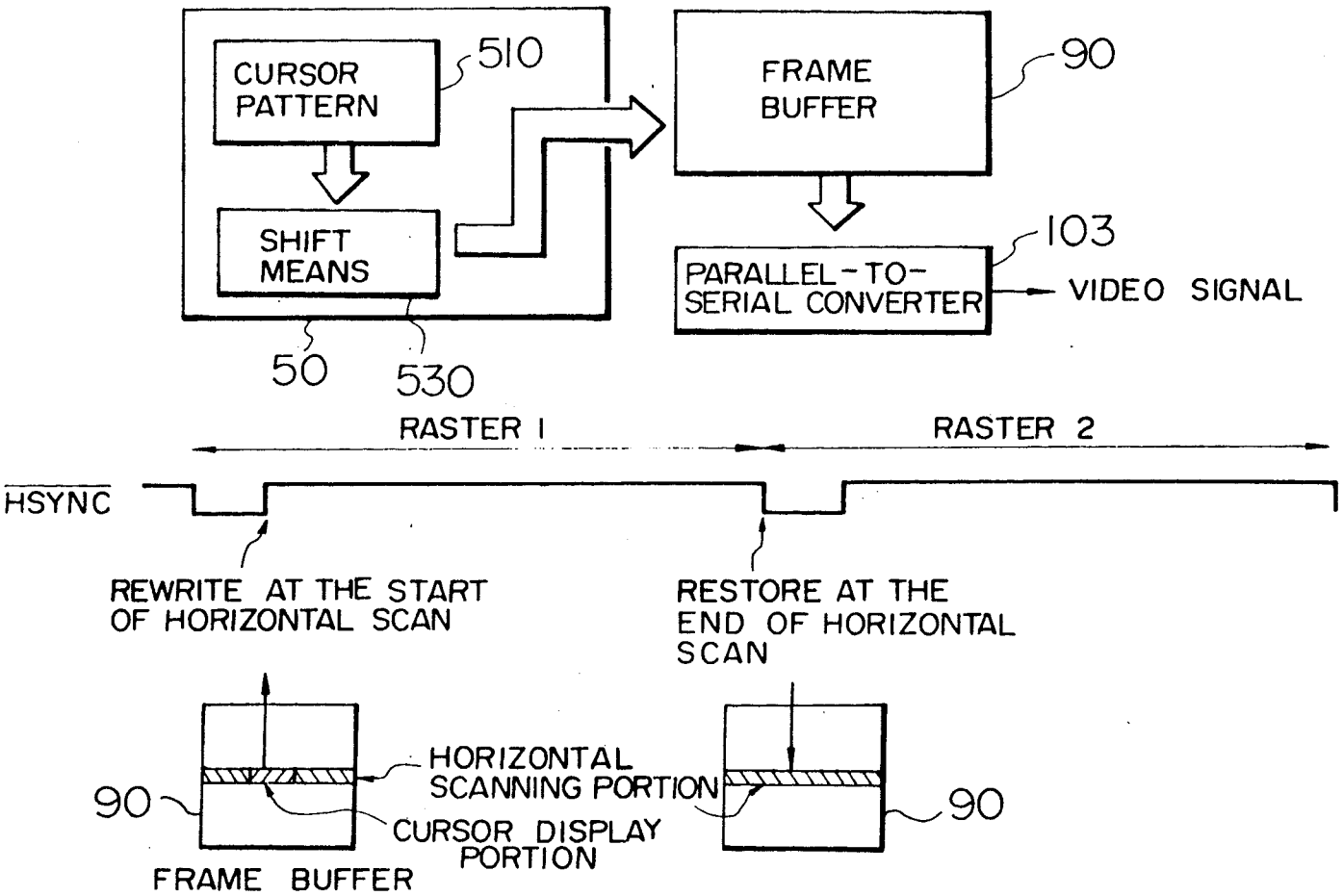
FIG. 14 is a diagram illustrating an example in which a cursor pattern is written in a display region of a frame buffer.

As the final embodiment, a system in which cursor pattern data are written in a frame buffer will be described with reference to FIG. 14.

First, one raster before displaying a cursor, data are shifted by a shift means 530 in order to adjust the display position. Next, immediately before scanning a raster to display the shifted data, the shifted data are written in a frame buffer region corresponding to the cursor display position. At this time, data of the frame buffer to be rewritten are retreated. And immediately after finishing scanning, the retreated data are returned to their original positions. The above operation is performed repeatedly with respect to a cursor display portion. In this system, no video signal generating circuit for cursor data is necessary, and the hardware for the video signal generating circuit is therefore simple.

As has been described above, according to the present invention, by separating a reading processing for displaying a cursor pattern from an adjusting processing for adjusting the dot position of the pattern data on a screen, it is possible to realize high speed movement of a cursor on the screen without requiring high speed operation of the pattern dot position adjusting processing. Moreover, since it is possible to reduce portions which require high speed operation, it is easy to integrate the system in an LSI, so that it is possible to realize an inexpensive display control apparatus.

What is claimed is:

1. A cursor display control method for performing display of a cursor together with characters and/or figures on a display screen, said cursor display control method comprising the steps of:

reading parallel cursor pattern data from cursor pattern storage means for storing a cursor pattern on a bit mapping basis;

shifting all of said parallel cursor pattern data in said cursor pattern storage means using a shift register in a continuous operation during a single non-display period of said cursor on a bit-by-bit basis;

converting said shifted parallel cursor pattern data into serial cursor pattern data at a display timing of said cursor; and performing display of said cursor based on said serial cursor pattern data.

2. A cursor display control method according to claim 1, wherein said cursor pattern storage means is provided in a display control apparatus for performing display control.

3. A cursor display control method according to claim 1, wherein said cursor pattern storage means is provided in a frame buffer for storing display data.

4. A cursor display control method for use in a system including a display control apparatus for controlling the display of a cursor, a frame buffer for storing display data, means for parallel-to-serial converting said display data of said frame buffer, and a display unit for displaying serial display data, said cursor display control method comprising the steps of:

shifting parallel cursor pattern data read from cursor pattern storage means included in said display control apparatus on a bit-by-bit basis and storing the shifted parallel cursor pattern data in said cursor pattern storage means;

controlling said shifting step to shift all of said data in said cursor pattern storage means during a vertical blanking interval of a display;

converting said shifted parallel cursor pattern data into serial cursor pattern data at a display timing of said cursor;

combining said serial display data with said serial cursor pattern data; and displaying said combined data on said display unit.

5. A display control apparatus for performing display of a cursor, said apparatus comprising:

cursor pattern storage means for storing a cursor pattern on a bit mapping basis;

shift means for shifting on a bit-by-bit basis parallel cursor pattern data read from said cursor pattern storage means and storing the shifted parallel cursor pattern data in said cursor pattern storage means;

control means for controlling said shift means to shift all of aid cursor pattern data during a vertical blanking interval of a display; and parallel-to-serial converting means for converting said shifted parallel cursor pattern data into serial cursor pattern data at a display timing of said cursor.

6. A display control apparatus according to claim 5, wherein said display control apparatus is formed in a configuration of an LSI.

7. A display control apparatus according to claim 5, wherein parallel cursor pattern data are supplied to said shift means and said parallel-to-serial converting means, and outputting data of said shift means are returned to said cursor pattern storage means.

8. A display control apparatus according to claim 5, wherein said cursor pattern storage means is provided in a portion of a frame buffer.

9. A display control apparatus for displaying a cursor, said apparatus comprising:

cursor pattern storage means for storing a cursor pattern on a bit mapping basis;

shift means for shifting parallel cursor pattern data read from said cursor pattern storage means;

control means for controlling said shift means to shift all of aid cursor pattern data stored in said cursor pattern storage means during a vertical blanking interval of a display on a bit-by-bit basis;

cursor display timing means for instructing a display timing of said cursor; and parallel-to-serial converting means for converting said shifted parallel cursor pattern data into serial cursor pattern data in response to a timing signal from said cursor display timing means.

10. A display control apparatus according to claim 9, wherein said display control apparatus is formed in a configuration of an LSI.

11. A graphic display system comprising:

display control means for controlling the display of a cursor;

a frame buffer for storing display data;

first conversion means for parallel-to-serial converting said display data of said frame buffer;

a display unit for displaying serial display data;

cursor pattern storage means for storing a cursor pattern on a bit mapping basis;

shift means included in said display control means for shifting parallel cursor pattern data read from said cursor pattern storage means;

control means for controlling said shift means to shift all of said cursor pattern data stored in said cursor pattern storage means during a vertical blanking interval of a display on a bit-by-bit basis;

second conversion means for converting said shifted parallel cursor pattern data into serial cursor pattern data at a display timing of said cursor; and combiner means for combining said display data from said first conversion means with said serial cursor pattern data from said second conversion means.

12. A graphic display control system comprising:

cursor pattern storage means for storing a cursor pattern;

parallel-serial conversion means for converting parallel data of a cursor pattern read from said cursor pattern storage means into a serial cursor pattern data to display said cursor pattern on a display screen;

shift means for shifting said read parallel cursor pattern data; and control means for controlling said shift means to shift all of the data from said cursor pattern storage means in a single continuous operation during a vertical blanking interval of a display.

13. A graphic display control system for displaying data on a display, comprising:

cursor pattern storage means for storing cursor data representing a cursor pattern on a bit mapping basis;

a shift register connected to receive said cursor data from said cursor pattern storage means for shifting bit-by-bit said cursor data and for storing shifted cursor data in said cursor pattern storage means;

at least one cursor display position register for storing a display position of a cursor;

a cursor data display register connected to receive shifted cursor data from said cursor pattern storage means for storing said shifted cursor data;

control circuit responsive to the display position stored in said cursor display position register for controlling the shifting of said shift register to shift all of the cursor data in said cursor pattern storage means during a vertical blanking interval of said display; and an output control circuit coupled to said cursor data display register for outputting said shifted cursor data to a display unit for display.

* * * * *